US008397833B2

(12) United States Patent
Stoetzer et al.

(10) Patent No.: US 8,397,833 B2
(45) Date of Patent: Mar. 19, 2013

(54) CONSTRUCTION APPARATUS WITH EXTENDABLE MAST AND METHOD FOR OPERATING SUCH A CONSTRUCTION APPARATUS

(75) Inventors: Erwin Emil Stoetzer, Aichach (DE); Leonhard Weixler, Thierhaupten (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 329 days.

(21) Appl. No.: 12/457,342

(22) Filed: Jun. 8, 2009

(65) Prior Publication Data

US 2009/0314547 A1 Dec. 24, 2009

(30) Foreign Application Priority Data

Jun. 13, 2008 (EP) ..... 08010845

(51) Int. Cl.
*B25B 21/02* (2006.01)
*B23Q 5/00* (2006.01)
*E21B 7/02* (2006.01)

(52) U.S. Cl. ..... 173/157; 173/28; 173/1

(58) Field of Classification Search ..... 173/184–185, 173/24–28, 141–160, 213–222, 38–44, 164–165; *B23Q 5/00; B21B 7/02; B25B 21/02*
See application file for complete search history.

(56) References Cited

U.S. PATENT DOCUMENTS 1,952,728 A * 3/1934 Rathbun ..... 254/269
2,811,335 A * 10/1957 Fletcher et al. ..... 173/189
3,087,296 A * 4/1963 Cowles ..... 56/10.7
3,141,559 A * 7/1964 Dragonuk ..... 414/590
3,165,157 A * 1/1965 Carbert ..... 173/28
3,181,624 A * 5/1965 Lindberg ..... 173/193
3,464,655 A * 9/1969 Schuman ..... 248/651
3,529,680 A * 9/1970 Jaeggi al. ..... 173/35
3,565,184 A * 2/1971 Gustafsson et al. ..... 173/28
3,721,304 A * 3/1973 Hanson ..... 173/2
3,744,574 A * 7/1973 Carley ..... 173/27
4,022,410 A * 5/1977 Ewart et al. ..... 248/647
4,436,455 A * 3/1984 Vance ..... 405/303

(Continued)

FOREIGN PATENT DOCUMENTS

DE 4436264 C1 11/1995
JP 2002-285775 10/2002

(Continued)

OTHER PUBLICATIONS

ISR for PCT Application 2007WO-FI050701—Priority date—Dec. 16, 2006.*

*Primary Examiner* — Robert Long
(74) *Attorney, Agent, or Firm* — Jacobson Holman PLLC

(57) ABSTRACT

A construction apparatus having an extendable mast with an upper mast element longitudinally displaceable relative to a lower mast element. A linear drive displaces the mast elements relative to each other, and has an upper drive part linearly actuable relative to a lower drive part of the linear drive, and a locking device for locking the two mast elements in an extended mast position. The upper drive part is fixable to the upper mast element, the lower drive part of the linear drive is displaceable longitudinally of the lower mast element and a securing device is provided on the lower mast element, with which the lower drive part is releasably securable to the lower mast element for displacement of the upper mast element. A method for operating a construction apparatus with an extendable mast can be carried out with a construction apparatus in accordance with the invention.

10 Claims, 11 Drawing Sheets

U.S. PATENT DOCUMENTS

| | | | | | |
|---|---|---|---|---|---|
| 4,544,040 | A * | 10/1985 | Sweeney | 173/91 |
| 4,671,365 | A * | 6/1987 | Back | 173/28 |
| 4,757,866 | A * | 7/1988 | Szoke | 173/152 |
| 4,858,700 | A * | 8/1989 | Shafer | 173/185 |
| 5,213,169 | A * | 5/1993 | Heller | 175/122 |
| 5,273,124 | A * | 12/1993 | Lloyd et al. | 175/162 |
| 5,350,023 | A * | 9/1994 | Klemm | 173/17 |
| 5,375,664 | A * | 12/1994 | McDowell et al. | 173/1 |
| 5,377,767 | A * | 1/1995 | Briggs | 173/28 |
| 5,709,276 | A * | 1/1998 | Lee | 175/122 |
| 5,733,068 | A * | 3/1998 | Reinert, Sr. | 405/232 |
| 5,803,189 | A * | 9/1998 | Geldner | 175/113 |
| 5,820,317 | A * | 10/1998 | Van Troba | 408/136 |
| 5,937,952 | A * | 8/1999 | Bigoney | 173/190 |
| 5,954,143 | A * | 9/1999 | McCabe et al. | 173/184 |
| 6,315,059 | B1 * | 11/2001 | Geldean | 173/31 |
| 6,814,155 | B1 * | 11/2004 | Nielson et al. | 173/152 |
| 7,182,140 | B2 * | 2/2007 | Wood | 166/379 |
| 7,185,708 | B2 * | 3/2007 | Wood et al. | 166/379 |
| 7,198,115 | B2 * | 4/2007 | Cardoso | 173/13 |
| 7,640,998 | B2 * | 1/2010 | Howell, Jr. | 173/184 |
| 7,905,300 | B2 * | 3/2011 | Rieder et al. | 175/122 |
| 8,046,959 | B2 * | 11/2011 | Stoetzer et al. | 52/116 |
| 2004/0104192 | A1 * | 6/2004 | Stowasser et al. | 212/348 |
| 2006/0070816 | A1 * | 4/2006 | Schroder | 187/222 |
| 2008/0149395 | A1 * | 6/2008 | Fossbakken et al. | 175/162 |
| 2008/0190633 | A1 * | 8/2008 | Johnston et al. | 173/184 |
| 2008/0217037 | A1 * | 9/2008 | Howell | 173/28 |
| 2009/0095491 | A1 * | 4/2009 | Wood et al. | 166/384 |
| 2009/0139731 | A1 * | 6/2009 | Rieder et al. | 166/381 |
| 2010/0012340 | A1 * | 1/2010 | Kuosmanen | 173/184 |
| 2011/0290564 | A1 * | 12/2011 | Agostini | 175/162 |

FOREIGN PATENT DOCUMENTS

| | | | |
|---|---|---|---|
| SU | 200537 | A | 11/1967 |
| SU | 800285 | A | 1/1981 |
| SU | 1229304 | A1 | 5/1986 |
| WO | WO 2008074918 | A1 * | 6/2008 |

* cited by examiner

CONSTRUCTION APPARATUS WITH EXTENDABLE MAST AND METHOD FOR OPERATING SUCH A CONSTRUCTION APPARATUS

BACKGROUND OF THE INVENTION

1. Field of the Invention

The invention relates to a construction apparatus designed with an extendable mast having an upper mast element and a lower mast element, whereby the upper mast element is longitudinally displaceable relative to the lower mast element, a linear drive for displacement of the two mast elements relative to each other, wherein the linear drive has an upper drive part which can be actuated in a linear manner relative to a lower drive part of the linear drive, and a locking device for locking the two mast elements in an extended mast position.

The invention further relates to a method for operating a construction apparatus, in particular a construction apparatus according to the invention, in which the linear drive is extended and in doing so the upper mast element is extended, afterwards the two mast elements are locked in an extended mast position, afterwards the lower drive part is released from the lower mast element and the lower drive part is moved longitudinally of the lower mast element and in doing so a workload arranged on the lower drive part is lifted.

2. Description of Related Art Including Information Disclosed Under 37 CFR §§1.97 and 1.98

A generic construction apparatus is known from JP 2002-285775. This printed publication discloses a construction apparatus with a two-part extendable mast. For the extension of the mast a mast cylinder is provided. This mast cylinder is connected on its piston rod to the lower mast element. On its cylinder housing the mast cylinder has a contact-pressure surface that takes along the upper mast element during the extension of the mast cylinder. In addition to the mast cylinder also a feed cylinder for displacement of a drilling carriage is present.

In accordance with JP 2002-285775 the cylinder housing of the feed cylinder is connected to the cylinder housing of the mast cylinder. Due to this connection the drilling carriage also has to be lifted during the extension of the upper mast element so that correspondingly high power needs to be applied for the extension.

BRIEF SUMMARY OF THE INVENTION

The object of the invention is to provide a construction apparatus and a method for operating a construction apparatus, which permit particularly high efficiency whilst ensuring high reliability and versatility of use.

The object is achieved in accordance with the invention by a device having an extendable mast having an upper mast element and a lower mast element, wherein the upper mast element is longitudinally displaceable relative to the lower mast element, and a linear drive for displacement of the two mast elements relative to each other, wherein the linear drive has an upper drive part which can be actuated in a linear manner relative to a lower drive part of the linear drive, and a locking device for locking the two mast elements in an extended mast position, wherein the upper drive portion of the linear drive is attached to the upper mast element, the lower drive portion of the linear drive along the lower mast element can slide, and a fixing device is provided at the lower pole element, with which the lower drive unit for moving the upper mast element detachably at the lower pole element is fixed. The object of the invention is further achieved by a method in which the linear drive is extended and in doing so the upper mast element is extended, afterwards the two mast elements are locked in an extended mast position, afterwards the lower drive part is released from the lower mast element and the lower drive part is moved longitudinally of the lower mast element and in doing so a workload arranged on the lower drive part is lifted.

A construction apparatus according to the invention is characterized in that the upper drive part of the linear drive is fixed to the upper mast element, in that the lower drive part of the linear drive can be displaced longitudinally of the lower mast element and in that on the lower mast element a securing device is provided with which the lower drive part of the linear drive can be secured in a releasable manner to the lower mast element for displacement of the upper mast element.

In accordance with the invention a mast consisting of at least two parts is provided, whose two mast parts can be extended and, by preference, can also be retracted again by means of a linear drive. Here, the linear drive is fixed at its upper side to the upper mast element. A central idea of the invention can be considered to reside in the fact that on its opposite-lying lower side the linear drive is only secured temporarily to the lower mast element, namely at that time when the two mast elements are to be extended or retracted relative to each other by means of the linear drive. The temporary fixing of the lower drive part to the lower mast element, which is brought about by means of the securing device, renders it possible that the compressive forces that act in the linear drive during the retraction and extension of the mast elements are transmitted to the lower mast element.

However, once the displacement process of the two mast elements is completed, the mast elements can be fixed relative to each other by means of the locking device, which means that the upper mast element is from then on supported by the locking device. The invention is based on the finding that after completion of the locking the linear drive is no longer needed for supporting the upper mast element and can therefore be used for other drive purposes. Consequently, in the construction apparatus according to the invention the lower drive part of the linear drive can be cleared by the securing device after the locking of the mast elements and can therefore be released from the lower mast element so that the lower drive part can again be displaced longitudinally of the lower mast element. The linear drive, which was initially used for the extension of the mast and is suspended on the upper mast element of the now-locked mast, can now serve other lifting purposes. In particular, by means of the linear drive loads can be lifted and lowered longitudinally of the lower mast element. For example, by means of the lower drive part of the linear drive it is possible to lift and lower a drilling carriage with a drill drive longitudinally of the mast.

According to the invention the extension of the mast and the displacement of the drilling carriage longitudinally of the mast can therefore be achieved with one and the same linear drive so that a separate drive for the movement of the carriage relative to the mast is not required. Consequently, according to the invention an especially efficient and at the same time versatile construction apparatus is obtained.

According to the invention provision is made for the linear drive to be positioned on the mast base only temporarily, namely in particular for the extension of the mast. When the mast is extended to the desired height, in particular fully extended, the upper mast part is locked with respect to the lower mast part. The linear drive can then be used for lifting tasks and can be connected for this purpose with its lower drive part to the carriage for example.

Advantageously, the construction apparatus has a control which is adapted such that, in particular when the mast is extended, a connection established via the securing device between the lower drive part and the lower mast element for the transmission of compressive forces from the lower drive part to the lower mast element is only cleared, if the two mast elements are locked by means of the locking device.

By preference, the construction apparatus according to the invention can be a soil working apparatus, such as a drilling apparatus for example.

The linear drive according to the invention is used in particular for the extension of the upper mast element, i.e. for distance enlargement. However, it can also be employed for the retraction of the upper mast element. For the retraction provision can be made for the lower drive part to be secured initially again by means of the securing device to the lower mast element, for the locking device to be cleared subsequently and for the linear drive to be finally retracted together with the upper mast element. Hence, the displacement of the mast elements and the linear drive can be understood as both an extension and a retraction. The upper mast element can be understood in particular as the one of the two mast elements which is located further away from the ground.

The upper drive part can also be fixed in an articulated manner to the upper mast element, i.e. it can be linked to the upper mast element. In order to be able to lift loads by means of the linear drive, the upper drive part is suitably fixed to the upper mast element in such a way that tensile forces can be transmitted via the fixing from the linear drive to the upper mast element. For especially high operating safety provision can be made on the lower and/or upper mast element for a guide device, which guides the lower drive part that is displaceable relative to the lower mast element. In accordance with the invention such a guide can still be present, when the lower drive part is cleared by the securing device.

Advantageously, the locking device is remote-controlled, for example remote-controlled hydraulically, and can be designed in particular in a form-fitting manner. For instance it can have a lock, more particularly a bolt, which, for the purpose of locking, is guided through corresponding recesses located in the upper mast element and in the lower mast element. In particular the locking device can be provided on the lower mast element. Alternatively or in addition to the form-fitting locking device a force-fitting locking device can basically be provided.

In particular, to achieve an especially great stroke of the linear drive the securing device is advantageously provided in the area of the mast base, i.e. in an end portion of the lower mast element facing away from the upper mast element and directed towards the ground.

It can be sufficient if the securing device secures the lower drive part only in one spatial direction to the lower mast element. Since normally only compressive forces occur in the linear operation during the displacement of the upper mast element, it can be sufficient if the securing device secures the lower drive part against a displacement directed away from the upper mast element, i.e. directed downwards.

It is especially preferred that the securing device has a stop which suitably limits a displacement path of the lower drive part away from the upper mast element, i.e. which limits, in particular, the displacement path in the downward direction. In such case the securing device can be designed in an entirely passive way without any active setting elements so that a construction apparatus is obtained that is particularly simple and reliable from a constructional viewpoint. For especially high operating safety the stop can also be combined with active securing means. According to the invention the stop is designed such that it is able to take up at least the forces acting in the linear drive during the extension of the two mast elements and to transfer these forces to the lower mast element. The stop can also be adjustable. More particularly, it can be moved out of the path of the lower drive part and moved back into the path again. In addition, the stop can also be height-adjustable. In accordance with the invention the stop is arranged on the lower mast element.

The securing device can also have e.g. an adjustable lock or a clamping device, with which the lower drive part can be connected temporarily to the lower mast element for displacement of the mast elements. In this way the lower drive part can be secured in several spatial directions to the lower mast element, which may be of advantage even if tensile forces have to be reckoned with.

A preferred embodiment of the invention resides in the fact that the linear drive is a hydraulic cylinder. As a result, high efficiency accompanied with high reliability is achieved. In this case the drive parts of the linear drive can be constituted by a piston rod and respectively a cylinder housing of the hydraulic cylinder. In principle, other types of linear drive, such as a rack-and-pinion drive, are conceivable, too. For best suitability, the hydraulic cylinder is double-acting allowing for both a controlled extension and a controlled retraction. With regard to the transport dimensions and the operating reliability it is especially advantageous that the linear drive, in particular the hydraulic cylinder, extends in the inside of the two mast elements.

It is especially preferred that the linear drive is a hydraulic cylinder with two opposite lying piston rods. In this case the upper drive part can be a first piston rod and the lower drive part can be a second piston rod, with a cylinder housing being arranged between the two piston rods. Due to the design with two piston rods an especially high buckling strength can be achieved at a low weight. If two piston rods are provided, it is suitable for the cylinder housing to be longitudinally displaceable both relative to the upper mast element and relative to the lower mast element.

Another advantageous embodiment of the invention resides in the fact that on the mast a carriage is provided, which can be displaced longitudinally of the mast and has a drill drive, in particular. The drill drive can be a rotary drive, a roto-percussive drive and in general also a regular vibrator. It is especially advantageous that the drill drive can be pivoted on the carriage about an axis that preferably extends in the horizontal direction. In this way it is possible to arrange the output shaft of the drill drive in an approximately horizontal manner for a simple attachment of a drill rod section and to then pivot the output shaft together with the drill rod attached thereto into the vertical for drilling purposes. For best suitability, the carriage can be displaced both longitudinally of the lower mast element and longitudinally of the upper mast element.

If a carriage is provided it is of advantage in accordance with the invention that on the lower drive part of the linear drive a connecting part is provided for connecting the lower drive part to the carriage. This connecting part makes it possible to connect the lower drive part of the linear drive to the carriage and the rotary drive after the locking of the two mast elements so that the linear drive which was originally employed for extension can now serve for lifting and lowering the carriage. The connecting part is suitably provided at the lower end of the lower drive part. The connecting part can be designed for example for a bolt connection to the carriage.

If a connecting part is provided for connecting the lower drive part to the carriage, the stop of the securing device that limits the displacement path of the lower drive part is suitably arranged in the path of the connecting part. According to this embodiment the lower drive part rests through the connecting part on the stop and is thus secured temporarily through the connecting part to the lower mast element.

Furthermore, according to the invention it is of advantage that on the mast an auxiliary carriage is provided which can be displaced longitudinally of the mast, and that means are provided for connecting the auxiliary carriage to the carriage. By means of this auxiliary carriage the carriage can be moved longitudinally of the mast even if the carriage is not connected to the lower drive part of the linear drive. However, by means of the auxiliary carriage it is also possible to apply additional force onto the carriage that acts in addition to the force of the linear drive. This may be especially advantageous during the extraction of a drill rod.

For instance provision can be made for the carriage to be connected to the auxiliary carriage during the displacement, in particular during the extension of the upper mast element, because in this case the linear drive is needed for actuation of the upper mast element and is not available for actuation of the carriage. However, the auxiliary carriage can also be connected to the carriage during the extraction of a drill rod. In such case the carriage can be connected at the same time to the lower drive part of the linear drive so that the auxiliary carriage can assist the linear drive or the carriage can be separate from the lower drive part so that the auxiliary carriage applies the tensile forces alone.

Advantageously, the means for connecting the auxiliary carriage to the carriage are provided for a bolt connection. For best suitability, the means for connecting the auxiliary carriage to the carriage can be remote-controlled hydraulically for example so that a reliable operation is on hand even when the carriage is difficult to access.

An especially compact type of construction can be attained in that the auxiliary carriage is arranged above the carriage. In principle, an arrangement below the carriage is conceivable, too.

In addition, it is particularly advantageous that the auxiliary carriage can be displaced both longitudinally of the upper mast element and longitudinally of the lower mast element. As a result, an especially great stroke of the auxiliary carriage, but also of the carriage that can be connected thereto and therefore of the drill drive, is given which permits e.g. a very time-saving extraction of the drill rod.

If an auxiliary carriage is provided, it is especially preferred that a drive, especially a winch drive, is provided for displacement of the auxiliary carriage.

To attain an especially simple construction the winch drive can be designed for the lifting of the auxiliary carriage, whereas the lowering of the auxiliary carriage takes place through gravity.

Furthermore, it is useful for the winch drive to have a rope winch. By preference, the rope winch is arranged on a frame, on which the lower mast element is arranged. The frame concerned can be a vehicle superstructure for example. In particular, the lower mast element can be linked in a pivotable manner to the frame about a horizontal axis so that the mast can be folded for transport purposes. On the frame a ground-facing mast extension can also be provided, which is located below the lower mast element when the mast is erected.

It is particularly preferred that a winch rope of the winch drive is guided around at least one deflection roller arranged on the upper mast element. The deflection roller is suitably provided in the portion of the mast head. With such a deflection roller an especially compact and reliable type of construction can be obtained. By preference, two deflection rollers having parallel, spaced axes are provided for the winch rope on the upper mast element in the portion of the mast head.

Moreover, provision can be made for the winch rope to be guided around a deflection roller arranged on the auxiliary carriage and/or for the winch rope to be guided around a deflection roller provided on the frame. As a result of this deflection, which can be of multiple type where applicable, a tackle mechanism can be created that reduces the force to be applied by the rope winch, which proves to be of advantage for the extraction of a heavy drill rod for example.

Another advantageous embodiment of the invention resides in the fact that the two mast elements can be telescoped. According to this embodiment the retracted mast elements are arranged inside each other, in which case it is useful for the upper mast element to be arranged inside the lower mast element. Through a telescopic design particularly compact transport dimensions can be obtained. In principle, however, the two mast elements can also be provided in a laterally offset manner. For best suitability, the two mast elements have an aligned guide, as for example a guide rail, for the carriage and/or the auxiliary carriage so that the carriage or respectively the auxiliary carriage can be moved longitudinally of both mast elements.

The method according to the invention is provided for operating a construction apparatus with an extendable mast, which has an upper mast element and a lower mast element, whereby the upper mast element is longitudinally displaceable relative to the lower mast element. In particular, the method can be provided for operating a construction apparatus according to the invention.

Pursuant to the method in accordance with the invention a linear drive is provided, which has an upper drive part and a lower drive part, whereby the upper drive part can be actuated in a linear manner relative to the lower drive part, and whereby the upper drive part of the linear drive is fixed to the upper mast element, the lower drive part is secured to the lower mast element for the transmission of compressive forces from the linear drive into the lower mast element, and the linear drive is extended and in doing so the upper mast element is extended. Afterwards, pursuant to the method in accordance with the invention, the two mast elements are locked in an extended mast position. Afterwards, pursuant to the method in accordance with the invention, the lower drive part is released from the lower mast element and the lower drive part is moved longitudinally of the lower mast element and, in doing so, a workload arranged on the lower drive part is lifted.

The aspects of the invention set out in conjunction with the method can equally be applied to the device according to the invention, just as the aspects of the invention mentioned in conjunction with the device can be applied to the method.

It can be sufficient if, for the purpose of transmitting the compressive forces, the lower drive part is secured to the lower mast element in one spatial direction only, more particularly if the lower drive part is secured against a movement in the downward direction. If tensile forces are also likely to occur, though the lower drive part can also be secured in two opposite spatial directions.

The securing of the lower drive part to the lower mast element can be effected in particular by means of a stop which is provided on the lower mast element and on which the lower drive part rests in the secured state. Then, the release of the lower drive part can take place through a simple lifting of the lower drive part from the stop.

A particularly preferred further development of the method resides in the fact that after the locking of the two mast elements the lower drive part is connected to a drill drive and that the lower drive part is moved together with the drill drive longitudinally of the lower mast element. In this case the workload is constituted at least in part by the drill drive.

BRIEF DESCRIPTION OF THE SEVERAL VIEWS OF THE DRAWINGS

In the following the invention will be described in greater detail by way of preferred embodiments shown schematically in the accompanying Figures, wherein.

DETAILED DESCRIPTION OF THE INVENTION

Figure 1:
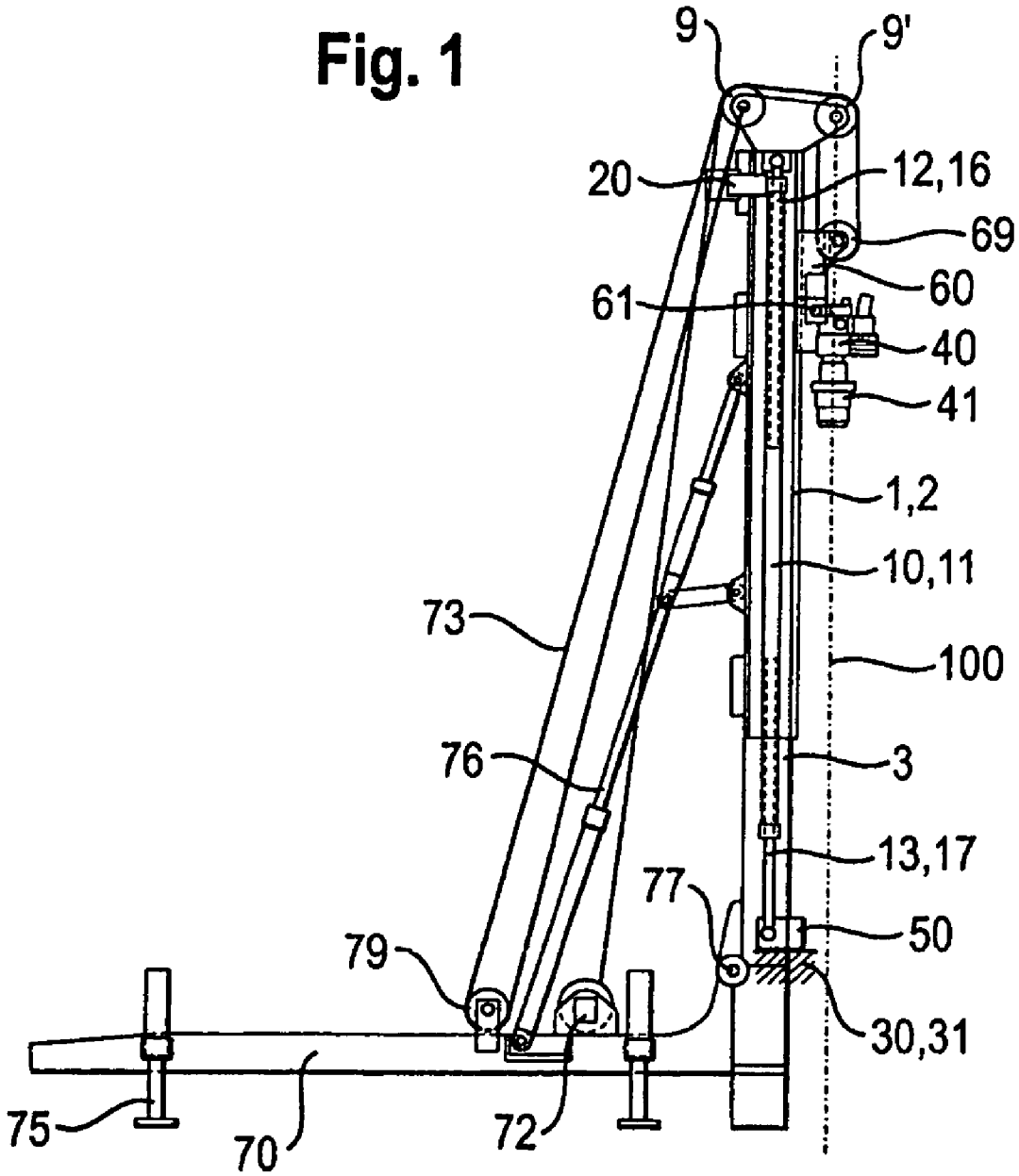
FIG. 1 to FIG. 11 show an embodiment of a construction apparatus according to the invention in different operating stages.

An embodiment of a construction apparatus according to the invention is shown in FIGS. 1 to 11. As shown in FIG. 1 in particular, the construction apparatus has a horizontally extending frame 70 which can be moved onto a trailer, not shown here, for transport purposes and which rests on the ground by means of four hydraulically actuated supports 75.

Through a pivot joint 77 a mast 1 is linked to the frame 70. The mast 1 can be pivoted about the pivot joint 77 between an approximately vertical operating position shown in the Figures and a horizontal transport position, not shown, in which the mast 1 extends approximately parallel to the frame 70. For the active pivoting of the mast 1 about the pivot joint 77 a hydraulic cylinder arrangement 76 is provided, which is linked on the one hand to the frame 70 and on the other hand to the mast 1.

The mast 1 has an upper mast element 2 and a lower mast element 3, the upper mast element 2 being displaceable longitudinally of the drilling axis 100 relative to the lower mast element 3 and the frame 70. Through displacement of the two mast elements 2 and 3 relative to each other the mast 1 can be retracted and extended. For example FIG. 1 shows the mast 1 in a retracted position, whereas FIG. 4, for example, shows the mast 1 in an extended position. In the retracted state depicted in FIG. 1 the upper mast element 2 rests on the lower mast element 3 so that a further movement of the upper mast element 2 in the downward direction is restrained by the lower mast element 3.

For the active displacement of the two mast elements 2 and 3 relative to each other, i.e. for the extension and retraction of the mast 1, a linear drive 10 is provided. The linear drive 10 has an upper drive part 12 as well as a lower drive part 13, wherein during the operation of the linear drive 10 the two drive parts 12 and 13 are displaced actively with respect to each other in the longitudinal direction of the drilling axis 100.

The linear drive 10 is designed as a hydraulic cylinder with a twin piston rod. As such the linear drive 10 has a central cylinder housing 11, on the upper side of which an upper piston rod 16 and on the underside of which a lower piston rod 17 can be extended and retracted. Here, the upper drive part 12 is constituted by the upper piston rod 16 and the lower drive part 13 is constituted by the lower piston rod 17.

The linear drive 10 designed as a hydraulic cylinder extends in the inside of the mast longitudinally of the drilling axis 100. On its upper end facing away from the cylinder housing 11 the upper drive part 12 (the upper piston rod 16) is linked to the upper mast element 2 in the upper area thereof. In this way the linear drive 10 is suspended on the upper mast element 2.

The lower drive part 13, i.e. the lower piston rod 17, is in turn supported in a displaceable manner longitudinally of the lower mast element 3 and in parallel to the drilling axis 100. However, the displacement path is limited at least temporarily by a securing device 30 described below in more detail.

The construction apparatus has a carriage 40 provided on the mast 1 by being displaceable longitudinally of the mast 1, in particular longitudinally of both mast elements 2 and 3. On the carriage 40 a drill drive 41 is arranged. The drill drive 41 can serve for the rotating operation of a drill rod 44, shown e.g. in FIG. 9, about the drilling axis 100.

The carriage 40 is connected in a releasable manner to an auxiliary carriage 60, which is also provided on the mast 1 by being displaceable longitudinally of the mast 1, in particular longitudinally of both mast elements 2 and 3. The auxiliary carriage 60 is arranged above the carriage 40. For the releasable connection of the carriage 40 to the auxiliary carriage 60 a connecting device 61 is provided, which is constituted in the illustrated embodiment by a bolt on the carriage 40 and a corresponding recess on the auxiliary carriage 60.

For the active movement of the auxiliary carriage 60 and of the carriage 40 that is optionally connected thereto a winch drive is provided. The winch drive has a rope winch 72 that serves for winding up a winch rope 73. The winch rope 73 runs from the rope winch 72 in succession to two deflection rollers 9, 9' provided paraxially on the upper end of the upper mast element 2. From the deflection rollers 9, 9' the winch rope 73 runs longitudinally of the drilling axis 100 in the downward direction to another deflection roller 69 arranged on the auxiliary carriage 60. The winch rope 73 is guided around the deflection roller 69 of the auxiliary carriage 60 and from there it runs upwards again back to the upper area of the upper mast element 2. There the winch rope 73 is deflected by a deflection device not shown in detail, from which it runs downwards again to another deflection roller 79 provided on the frame 70. The winch rope 73 coming from the auxiliary carriage 60 is guided around this deflection roller 79 of the frame 70 and runs from the deflection roller 79 upwards again to the upper end of the upper mast element 2, where the winch rope 73 is eventually fixed with its end. By the described multiple deflection of the winch rope 73, into which the auxiliary carriage 60 is suspension-mounted through its deflection roller 69, a tackle mechanism is created which renders it possible to apply by means of the rope winch 72 especially high tensile forces onto the auxiliary carriage 60 and therefore onto the carriage 40 with the drill drive 41 and which permits at the same time a simple folding of the mast 1 for transport purposes.

Figure 2:
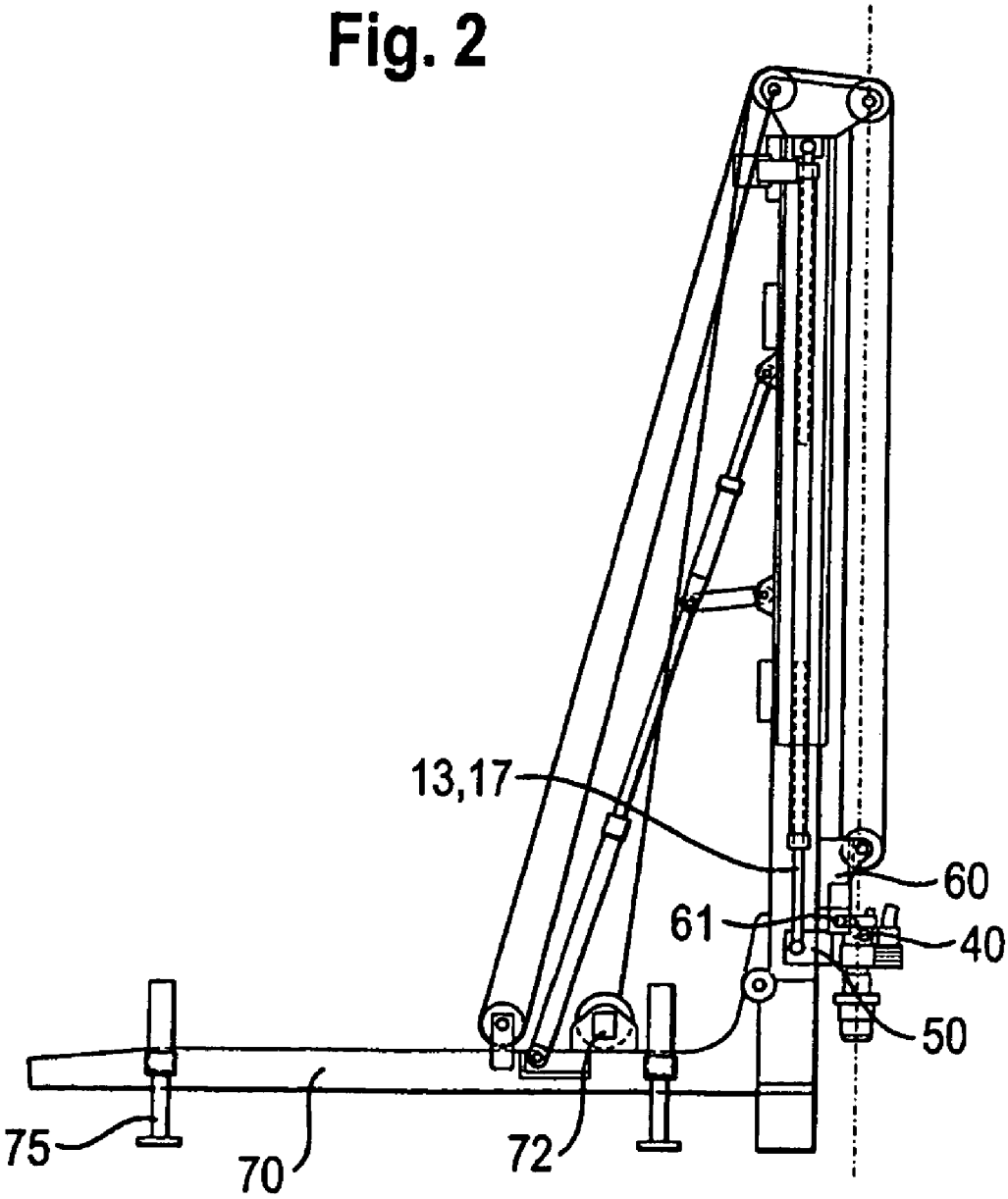

On its upper drive part 12 the linear drive 10 is suspended on the upper mast element 2. At the lower end of the lower drive part 13 a block-shaped connecting part 50 is fixed to the lower drive part 13, the said connecting part being guided on the lower mast element 3 in a longitudinally displaceable manner. As shown in FIG. 2 for example, the connecting part 50 is provided for producing a releasable connection to the carriage 40. Hence, by means of the connecting part 50 the carriage 40 can be connected in a releasable manner to the lower drive part 13. For connection to the carriage 40 the connecting part 50 can have e.g. means for producing a bolt connection.

As is furthermore shown in FIG. 1, the construction apparatus has a securing device 30. This securing device 30 is designed as a stop 31 that restrains a movement of the lower drive part 13 relative to the lower mast element 3. In the illustrated embodiment the stop 31 is arranged in the path of the connecting part 50 so that the movement of the lower drive part 13 is restrained through the connecting part 50.

The securing device 30 permits a temporary securing of the lower drive part 13 to the lower mast element 3, namely at those times when the lower drive part 13 and/or the connecting part 50 rests on the stop 31. In this temporarily secured state the linear drive 10 is in operative connection with both the upper mast element 2 and the lower mast element 2 so that the mast elements 2 and 3 can be extended through the actuation of the linear drive 10.

In order to lock the mast elements 2 and 3 in an extended position a remote-controlled locking device 20 is provided in the upper area of the lower mast element 3. The locking device 20 has a locking element which, for the purpose of locking, can be introduced into a corresponding recess in the upper mast element 2.

FIG. 1 shows the construction apparatus in a state immediately after the mast 1 has been brought into the vertical operating position by means of the hydraulic cylinder arrangement 76. In this state the auxiliary carriage 60 is connected to the carriage 40 and is located together with the carriage 40 in an upper area of the mast 1 on the upper mast element 2. The upper mast element 2 is retracted and rests on the lower mast element 3. The linear drive 10 is almost fully retracted, in which case the lower drive part 13 rests via the connecting part 50 on the stop 31 of the securing device 30.

For the extension of the mast 1 the auxiliary carriage 60 is initially lowered together with the carriage 40 through actuation of the rope winch 72. Then the carriage 40 is connected to the connecting part 50 and therefore to the lower drive part 13 and in doing so the connecting device 61 releases the carriage 40 from the auxiliary carriage 60. This state is shown in FIG. 2.

Figure 3:
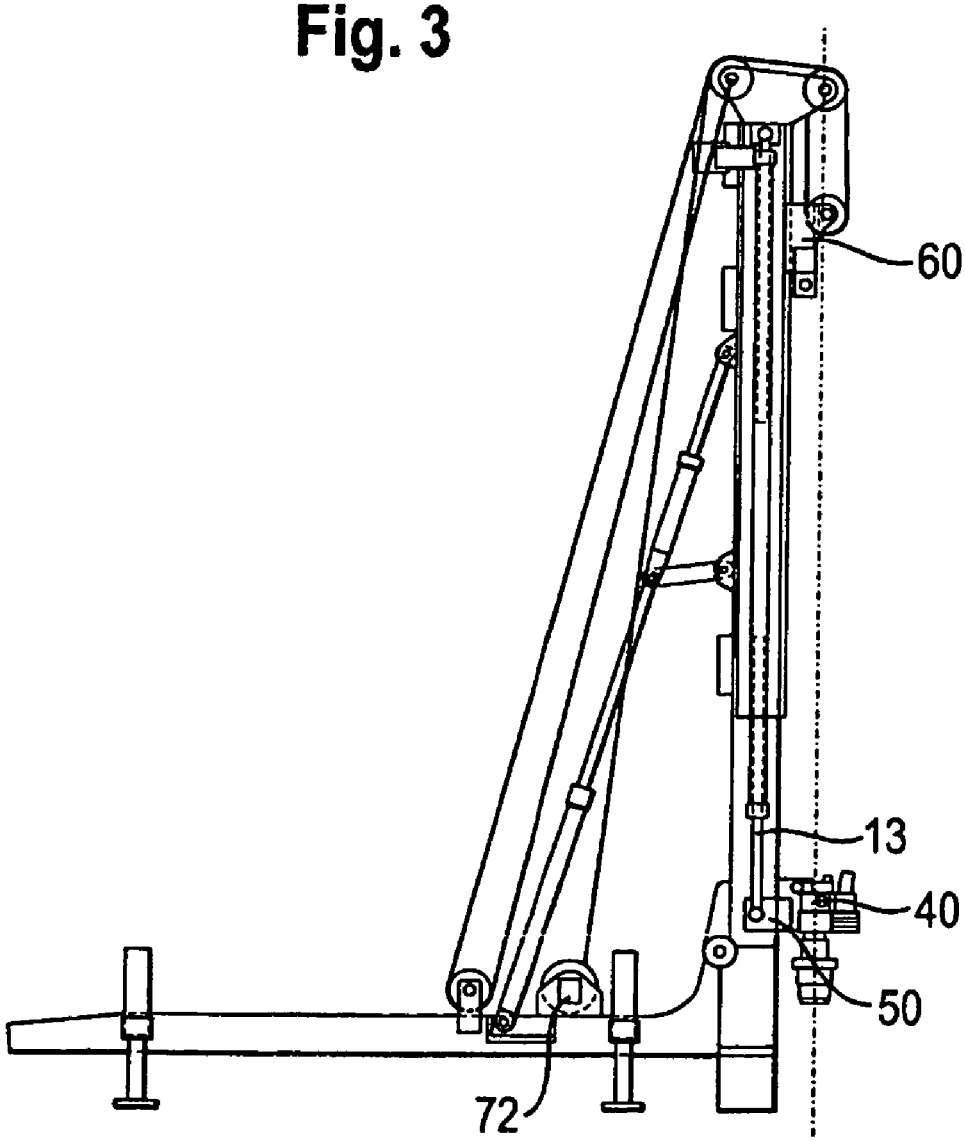

As shown in FIG. 3, through actuation of the rope winch 72 the auxiliary carriage 60 is then raised to an upper area of the mast 1 and is thereby lifted from the carriage 40. The carriage 40 remains connected through the connecting part 50 to the lower drive part 13 in a lower area of the mast 1.

Figure 4:
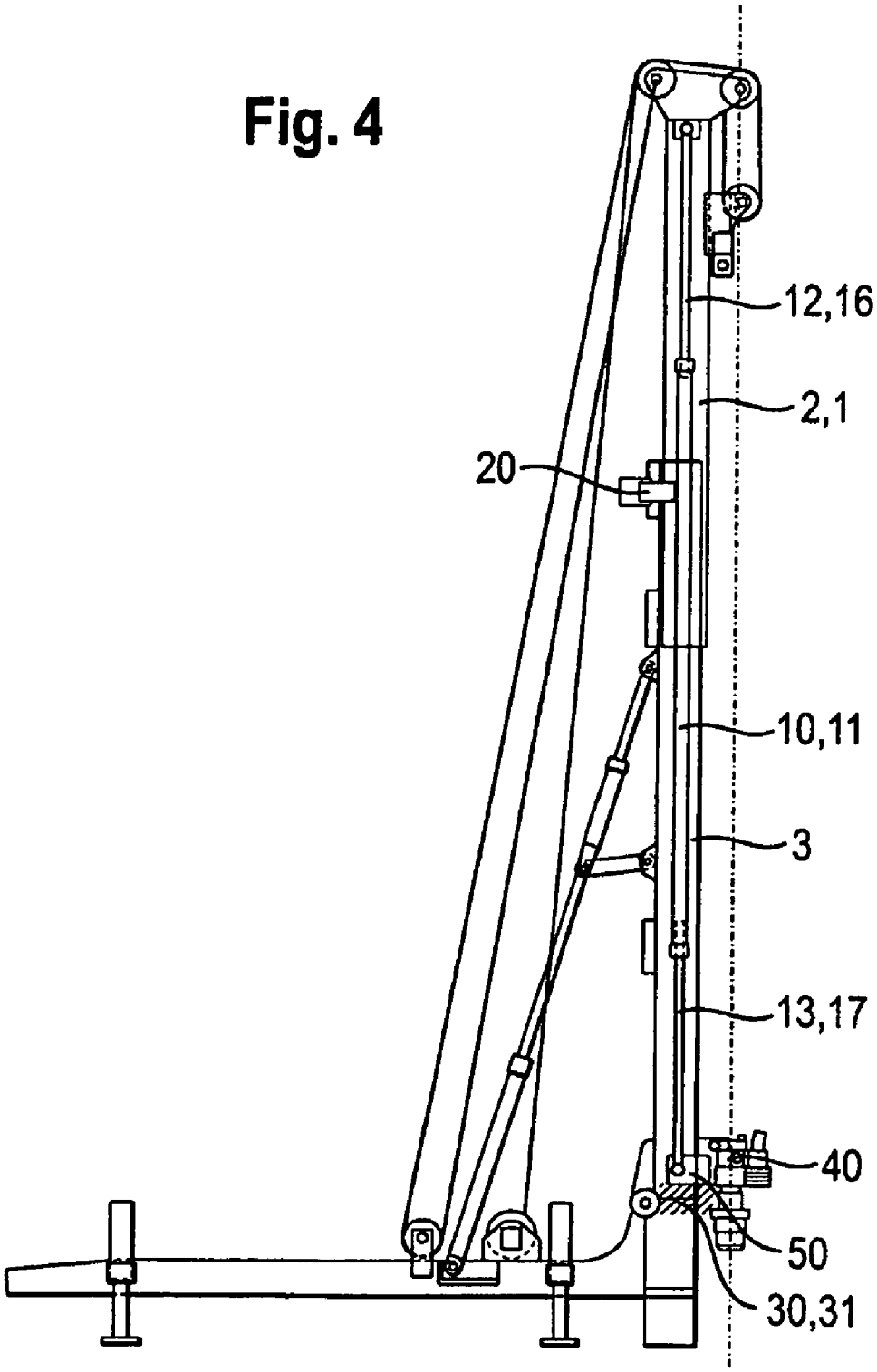

As shown in FIG. 4, the mast 1 is then extended. To this end the linear drive 10 is actuated so that the opposite lying piston rods 16 and 17, which constitute the upper drive part 12 and the lower drive part 13 respectively, move out of the cylinder housing 11. The lower drive part 13 rests through the connecting part 50 on the stop 31 of the securing device 30. Hence, via the stop 31 arranged on the lower mast element 3 compressive forces from the linear drive 10, and in particular the weight force of the upper mast element 2, can be introduced into the lower mast element 3 so that an upward directed reaction force can be applied to the upper mast element 2 in order to extend the upper mast element 2. Therefore the linear drive 10, together with the upper mast element 2, pushes itself upwards and away from the stop 31 so that the upper mast element 2 moves upwards relative to the lower mast element 3.

Figure 5:
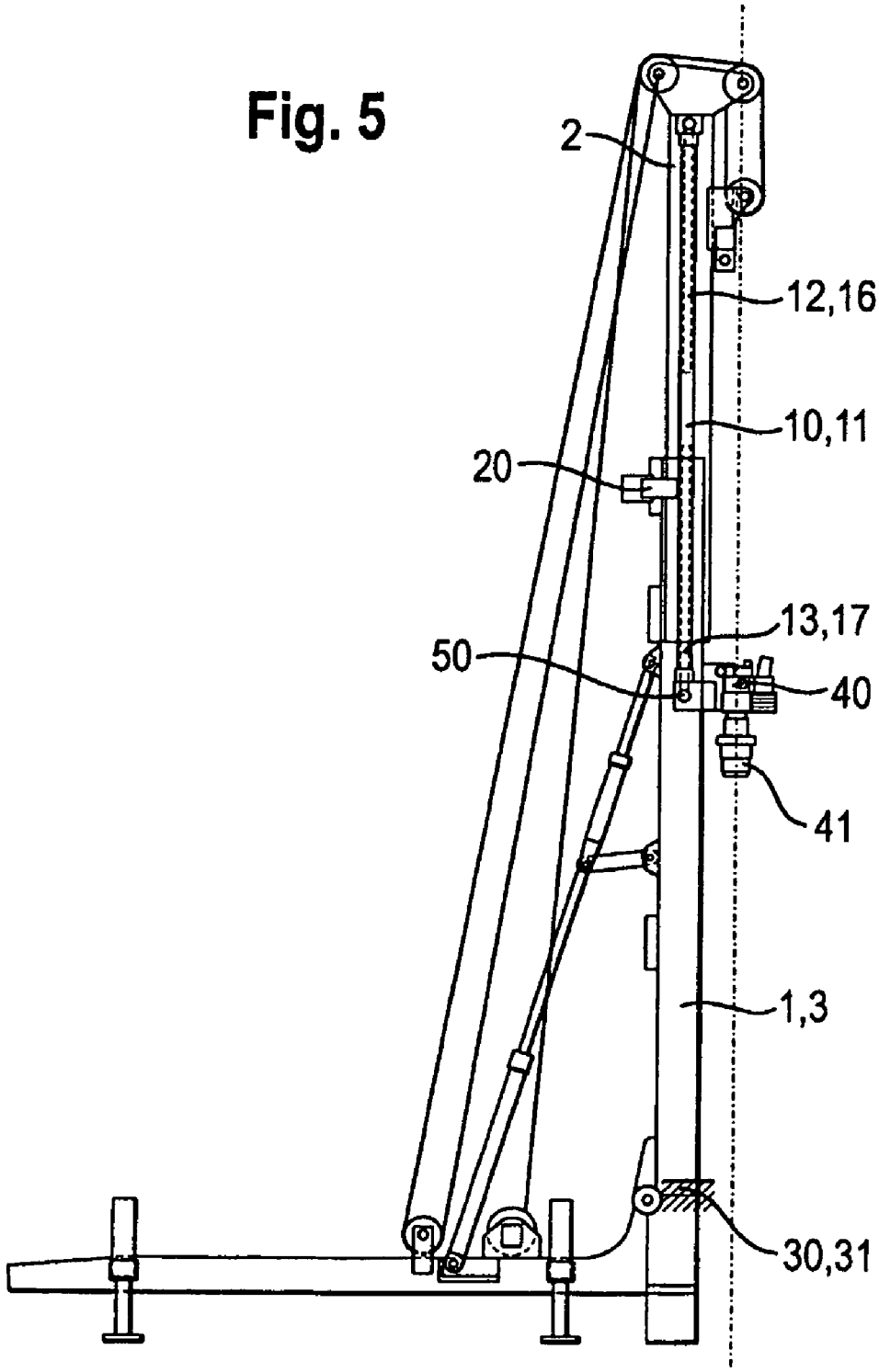

When the upper mast element 2 is extended to a desired height, in particular when fully extended, as shown in FIG. 4, the locking device 20 is actuated, i.e. a locking element of the locking device 20 is introduced into a corresponding recess on the upper mast element 2. From then on the weight force of the upper mast element 2 can be introduced via the locking device 20 into the lower mast element 3 so that the linear drive 10 is then available for lifting tasks, especially for lifting the carriage 40 relative to the mast 1. The use of the linear drive for lifting the carriage 40 is illustrated in FIG. 5. Since the upper mast element 2 is supported by the locking device 20, the linear drive 10 can be retracted without the upper mast element 2 being retracted thereby. Due to the fact that the upper drive part 12 is suspended on the upper mast element 2, the lower drive part 13 is moved upwards relative to the lower mast element 3 during the retraction of the linear drive 10. As a result, the connecting part 50 and the carriage 40 fixed thereto are also lifted and the carriage 40 is thus moved along the lower mast element 3.

During its lifting the connecting part 50 is raised from the stop 31 and in this way the temporary securing, brought about by the securing device 30, of the lower drive part 13 to the lower mast element 3 is released.

Figure 6:
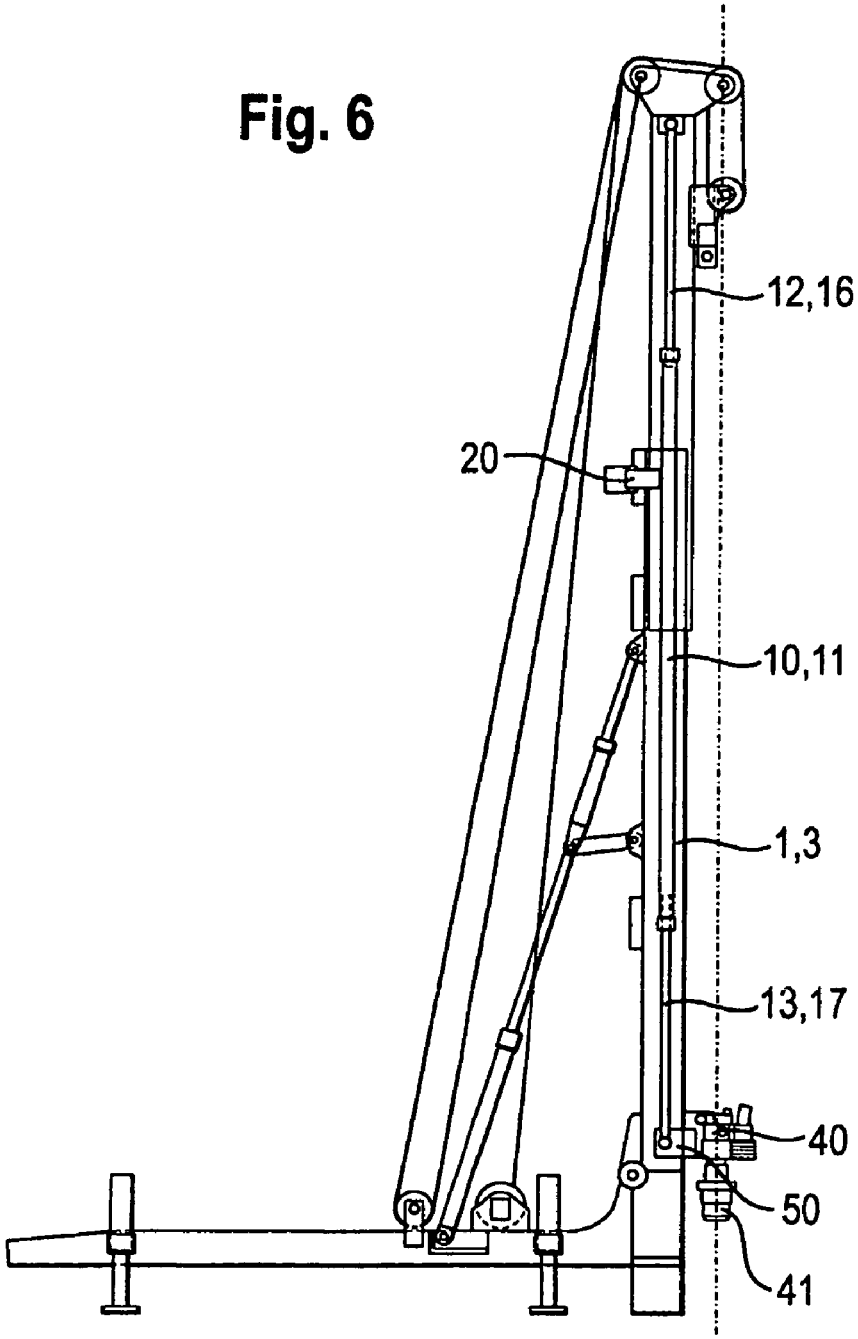

As depicted in FIGS. 5 and 6, when the mast 1 is extended and the locking device is secured the carriage 40 can be displaced together with the drill drive 41 longitudinally of the mast 1 in the upward and downward direction through actuation of the same linear drive 10 that was employed initially for the extension of the mast 1.

Figure 7:
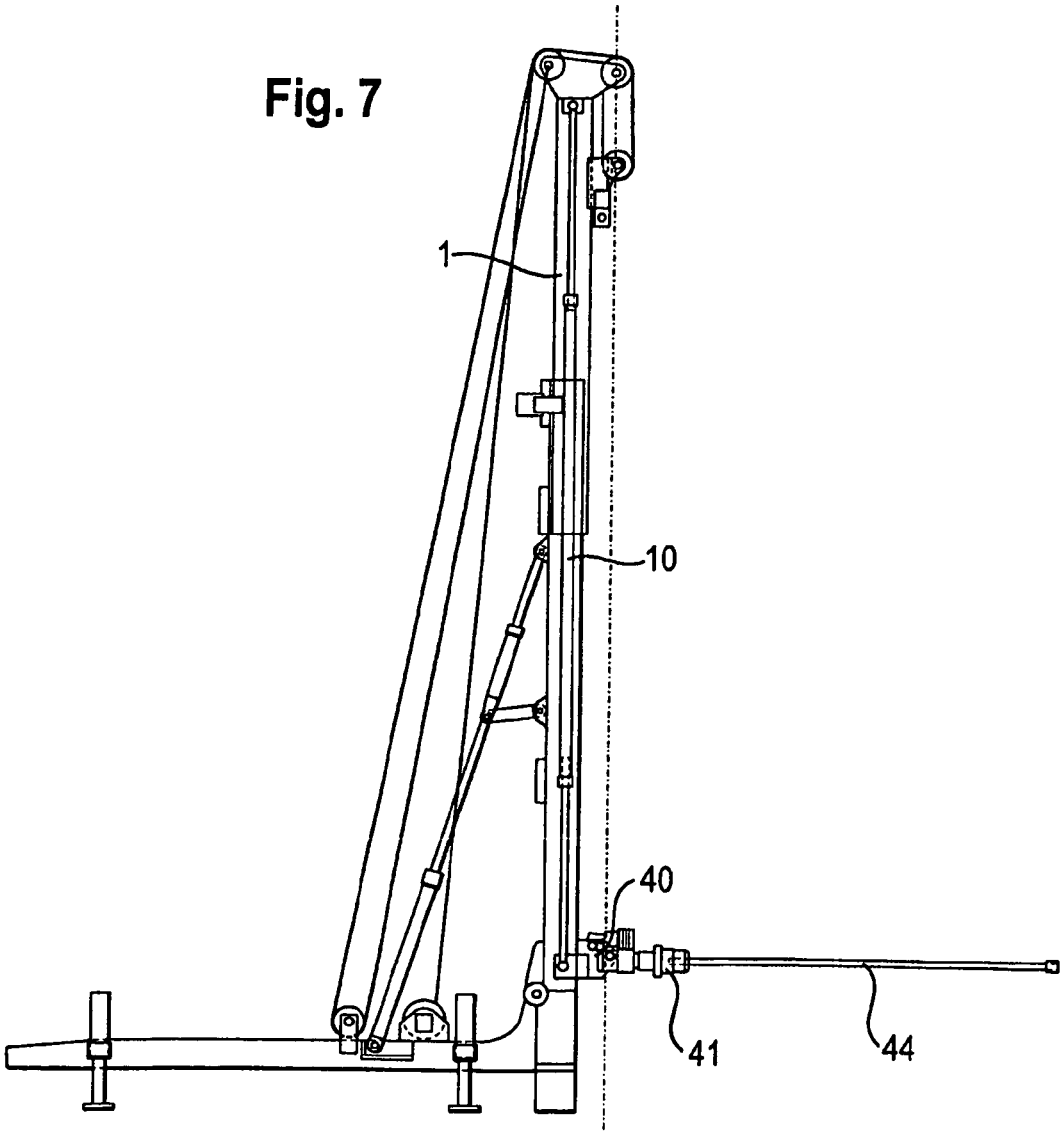
Figure 8:
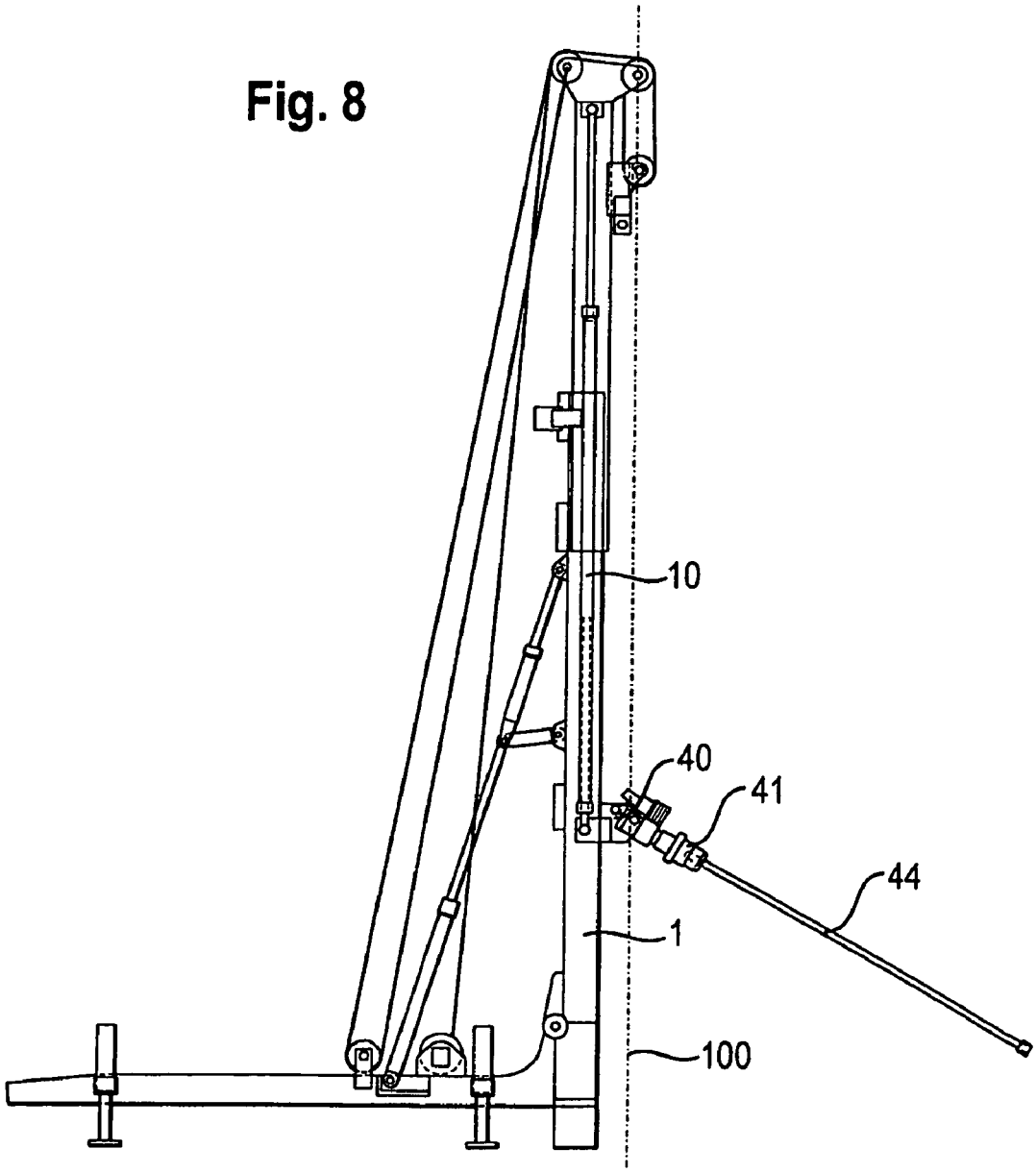
Figure 9:
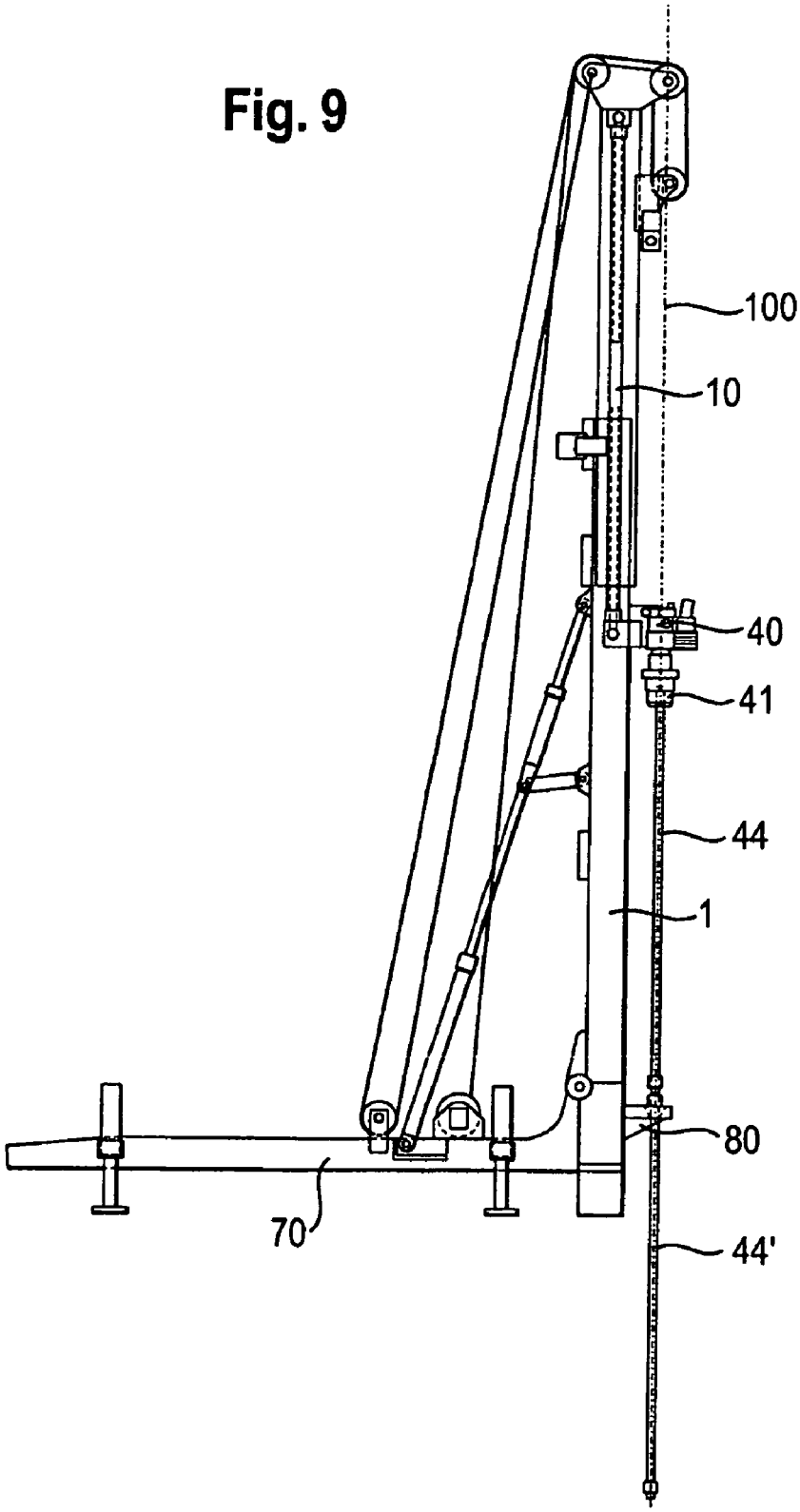

FIGS. 7 to 9 show the installation of a drill rod 44 on the drill drive 41. As shown in FIG. 7, the drill drive 41 is linked to the carriage 40 in a pivotable manner about a horizontally extending axis. In particular, the drill drive can thus be pivoted into the horizontal position shown in FIG. 7, in which the drill rod 44 can be introduced horizontally into the drill drive 41. Here, for reason of better accessibility the carriage 40 is moved with the drill drive 41 into a lower area of the mast 1 through extension of the linear drive 10.

Afterwards, as shown in FIG. 8, the linear drive 10 is retracted and the carriage 40 is lifted thereby. The drill drive 41, together with the drill rod 44 arranged therein, can thus be pivoted from the horizontal back to the vertically extending drilling axis 100.

As shown in FIG. 9, through retraction of the linear drive 10 the carriage 40 is lifted up to such a height that the drill drive 41 with the drill rod 44 is finally able to pivot into the drilling axis 100. For connection of the drill rod 44 to a further section of the drill rod 44', a holding device 80 can be provided on the frame 70 for example, with which device the drill rod 44' can be held temporarily. The holding device 80 can have e.g. at least one releasable clamping claw.

Figure 10:
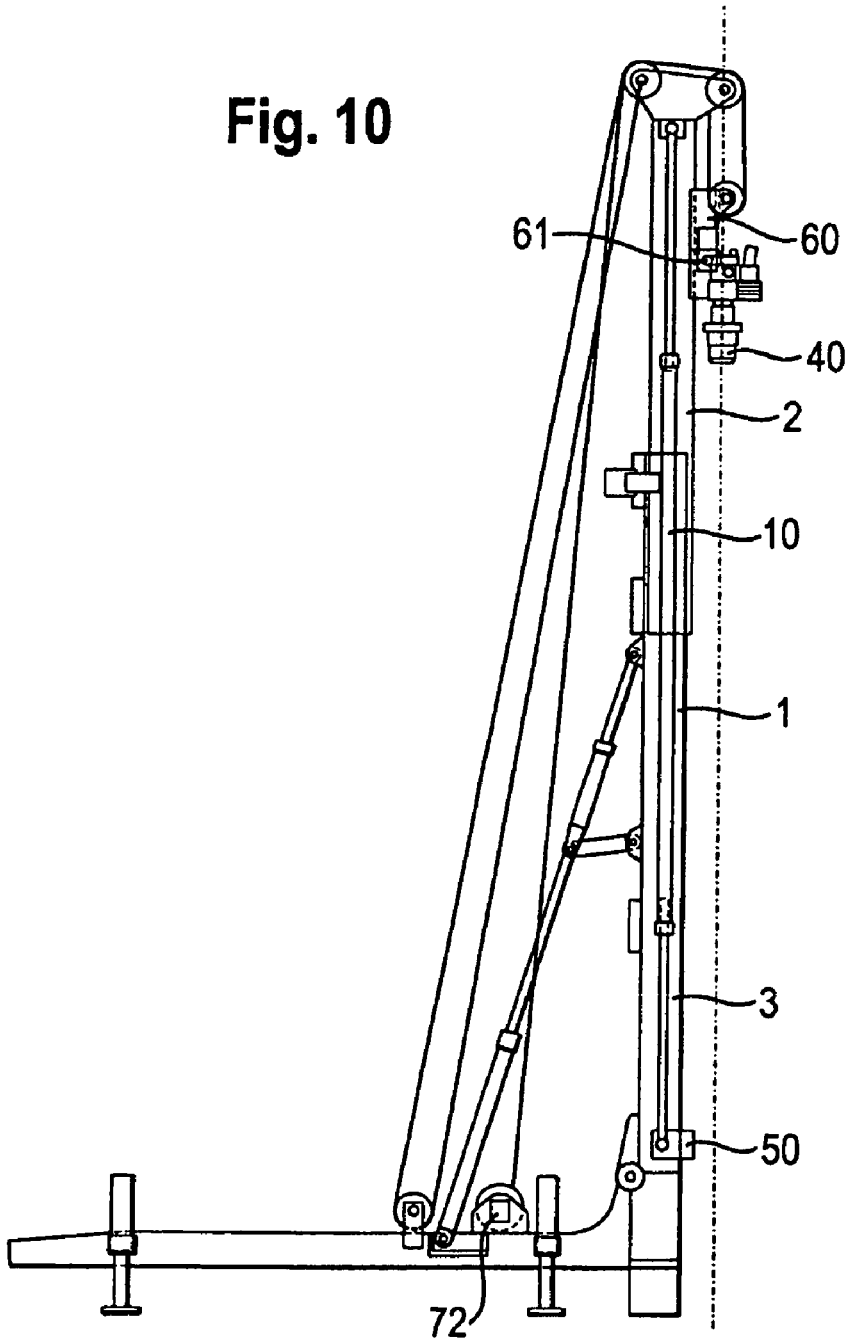
Figure 11:
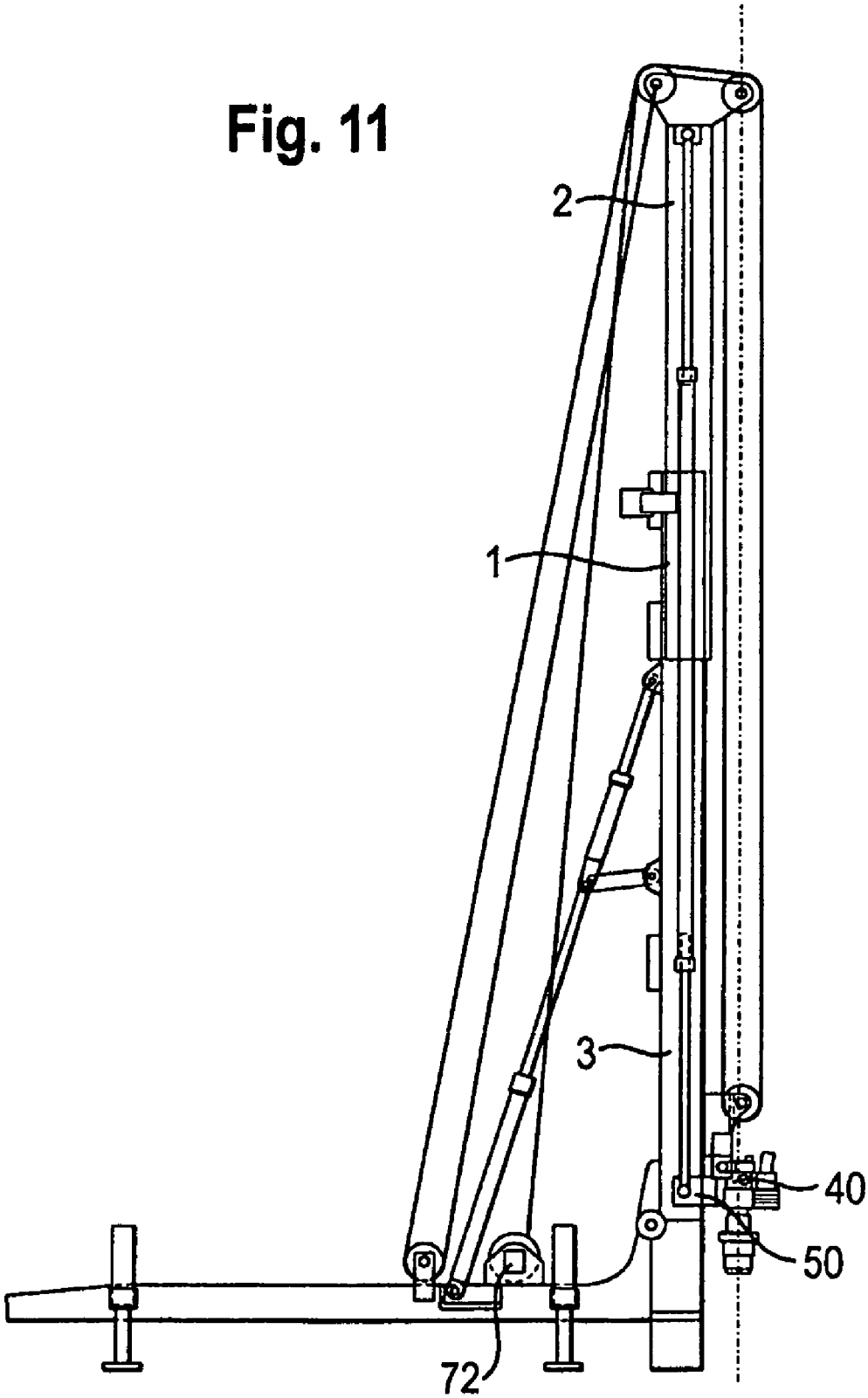

If an especially great stroke of the carriage is required, use can also be made of the auxiliary carriage 60 with the rope winch 72 for actuation of the carriage 40. For this purpose the carriage 40 is connected through the connecting device 61 to the auxiliary carriage 60 and the carriage 40 is released from the connecting part 50. As depicted in FIGS. 10 and 11, when the mast 1 is extended the carriage 40 can then be moved along both the lower mast element 3 and the upper mast element 2. If the connecting part 50 is arranged in the path of the carriage 40 and thereby limits the stroke of the carriage 40, the connecting part 50 is suitably arranged in a lower position through extension of the linear drive 10, as shown in FIGS. 10 and 11, so that the stroke of the carriage is not restricted.

If particularly high tensile forces are required it is also conceivable to connect the carriage 40 through the connecting device 61 to the auxiliary carriage 60 and at the same time through the connecting part 50 to the lower drive part 13 of the linear drive 10, in which case an upward directed tensile force can be applied to the carriage 40 by means of both the rope winch 72 and the linear drive 10.

The invention claimed is:

1. Construction apparatus comprising:

an extendable mast with an upper mast element and a lower mast element coaxial with the upper mast element, wherein the upper mast element is longitudinally displaceable relative to the lower mast element between an extended mast position and a retracted mast position, a linear drive for longitudinal displacement of the upper and lower mast elements relative to each other, wherein the linear drive has a lower drive part and an upper drive part coaxial with the lower drive part, the upper drive part being actuatable in a linear manner relative to the lower drive part of the linear drive, and a locking device for locking the two mast elements in the extended mast position, wherein the upper drive part of the linear drive is fixed to the upper mast element, the lower drive part of the linear drive is displaceably secured to the lower mast element for displacement of the upper mast element relative to the lower mast element, the lower drive part of the linear drive is displaceable from the lower mast element and displaceable longitudinally of the lower mast element when the upper mast element is fixed relative to the lower mast element, and a securing device is provided on the lower mast element, for displaceably securing the lower drive part to the lower mast element, the upper mast element being displaceable relative to the lower mast element when the lower drive part is secured to the lower mast element by the securing device.

2. Construction apparatus according to claim 1, wherein the securing device has a stop which limits a displacement path of the lower drive part away from the upper mast element.

3. Construction apparatus according to claim 1, wherein the linear drive is a hydraulic cylinder with two piston rods extending coaxially in opposite directions.

4. Construction apparatus according to claim 1, further comprising a main carriage which is provided on the mast, and which is displaceable longitudinally of the mast and has a drill drive, and a connecting part provided on the lower drive part of the linear drive for connecting the lower drive part to the main carriage.

5. Construction apparatus according to claim 4, further comprising:

an auxiliary carriage provided on the mast, the auxiliary carriage being displaced longitudinally of the mast, and means for connecting the auxiliary carriage to the main carriage.

6. Construction apparatus according to claim 5, wherein the auxiliary carriage is arranged above the main carriage and the auxiliary carriage is displaceable both longitudinally of the upper mast element and longitudinally of the lower mast element.

7. Construction apparatus comprising:

an extendable mast with an upper mast element and a lower mast element coaxial with the upper mast element, wherein the upper mast element is longitudinally displaceable relative to the lower mast element between an extended mast position and a retracted mast position, a main carriage provided on the mast, the main carriage being displaceable longitudinally of the mast and having a drill drive, a linear drive for longitudinal displacement of the upper and lower mast elements relative to each other, wherein the linear drive has a lower drive part and an upper drive part coaxial with the lower drive part, the upper drive part being actuatable in a linear manner relative to the lower drive part of the linear drive, a connecting part provided on the lower drive part of the linear drive for connecting the lower drive part to the main carriage, a locking device for locking the two mast elements in the extended mast position, an auxiliary carriage provided on the mast, the auxiliary carriage being displaced longitudinally of the mast, and means for connecting the auxiliary carriage to the main carriage, at least one upper mast element deflection roller arranged on the upper mast element, a frame, on which the lower mast element is arranged, an auxiliary carriage deflection roller arranged on the auxiliary carriage, a frame deflection roller provided on the frame, a winch drive provided for displacement of the auxiliary carriage, wherein the winch drive has a rope winch, which is arranged on the frame, a winch rope guided around the at least one upper mast element deflection roller, the auxiliary carriage deflection roller, and the frame deflection roller, and wherein:

the upper drive part of the linear drive is fixed to the upper mast element, the lower drive part of the linear drive is releasably secured to the lower mast element for displacement of the upper mast element relative to the lower mast element, the lower drive part of the linear drive is releasable from the lower mast element and displaceable longitudinally of the lower mast element when the upper mast element is fixed relative to the lower mast element, and a securing device is provided on the lower mast element, for releasably securing the lower drive part to the lower mast element, the upper mast element being displaceable relative to the lower mast element when the lower drive part is secured to the lower mast element by the securing device.

8. Construction apparatus according to claim 1, wherein the two mast elements can be telescoped.

9. Method for operating the construction apparatus according to claim 1, wherein the lower drive part is secured to the lower mast element for the transmission of compressive forces from the linear drive to the lower mast element, the method comprising the steps of:

extending the linear drive and in doing so, extending the upper mast element, after the step of extending the linear drive, locking the two mast elements in an extended mast position, after the step of locking the two mast elements, releasing the lower drive part from the lower mast element and moving the lower drive part longitudinally of the lower mast element and in doing so, lifting a workload arranged on the lower drive part.

10. Method according to claim 9, comprising the further step of:

after the step of locking of the two mast elements, connecting the lower drive part to a drill drive, and moving the lower drive part together with the drill drive longitudinally of the lower mast element.

* * * * *